US006406748B2

(12) United States Patent
Held, III et al.

(10) Patent No.: US 6,406,748 B2
(45) Date of Patent: Jun. 18, 2002

(54) PREVENTION OF PARTICLE REDEPOSITION ONTO ORGANIC SURFACES

(75) Inventors: Theodore D. Held, III, Grosse Pointe Farms; William E. Fristad, Rochester Hills, both of MI (US)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/782,411

(22) Filed: Feb. 13, 2001

Related U.S. Application Data

(60) Provisional application No. 60/182,324, filed on Feb. 14, 2000.

(51) Int. Cl.[7] ..... B05D 3/08; B05D 5/00

(52) U.S. Cl. ..... 427/223; 427/322; 427/409; 427/412.1; 427/419.2; 427/430.1; 427/435

(58) Field of Search ..... 427/223, 224, 427/404, 405, 409, 412.1, 430.1, 435, 322, 419.2

(56) References Cited

U.S. PATENT DOCUMENTS

| | | | | |
|---|---|---|---|---|
| 2,632,921 | A | 3/1953 | Kreidl | 18/47.5 |
| 3,364,056 | A | 1/1968 | Seibel | 117/46 |
| 3,557,691 | A | 1/1971 | Bayer | 101/129 |
| 3,841,895 | A | 10/1974 | Hick | 117/72 |
| 3,959,554 | A | 5/1976 | Hick | 428/336 |
| 4,068,035 | A | 1/1978 | Violland et al. | 428/279 |
| 4,201,824 | A | 5/1980 | Violland et al. | 428/262 |
| 4,567,106 | A | 1/1986 | Sano et al. | 428/413 |
| 4,891,160 | A | 1/1990 | Vander Meer | 252/545 |
| 4,974,307 | A | 12/1990 | Uebayashi et al. | 29/460 |
| 5,187,238 | A | 2/1993 | Iovine et al. | 525/327.2 |
| 5,223,106 | A | 6/1993 | Gerace et al. | 204/181.1 |
| 5,280,084 | A | 1/1994 | Paul | 525/375 |
| 5,464,477 | A | 11/1995 | Awad | 134/1 |
| 5,753,754 | A | 5/1998 | Strobel et al. | 525/61 |
| 5,879,757 | A | 3/1999 | Gutowski et al. | 427/491 |
| 5,891,967 | A | 4/1999 | Strobel et al. | 525/383 |
| 5,900,317 | A | 5/1999 | Strobel et al. | 428/412 |
| 5,919,517 | A | 7/1999 | Levendusky et al. | 427/211 |
| 5,922,161 | A | 7/1999 | Wu et al. | 156/272.6 |

OTHER PUBLICATIONS

Automotive Technical Bulletin, Brouder, E., The Problem Recognized Surface Treatment of Plastic Before Painting, May 13, 1987, pp. 37–38 (w/translation).

Briggs, et al., Journal of Materials Science, 14 (1979), "X–ray photoelectron spectrocopy studies of polymer surfaces", pp. 1344–1347.

Journal of Adhesion Science & Technology, vol. 9, Stobel, et al, A Comparison of Gas–Phase Methods of Modifying Polymer Surfaces pp. 365–383, 1995.

Macplas Int., Nov. 1990, Maltese et al., "Surface Treatment and Finishing", Nov. 1990, pp 87–90.

Encyclopedia of Polymer Science and Engineering, Second Edition, (1989), Supplement Volume, Wiley–Interscience, pp. 674–689.

*Primary Examiner*—Shrive P. Beck
*Assistant Examiner*—Kirsten A. Crockford
(74) *Attorney, Agent, or Firm*—Stephen D. Harper

(57) ABSTRACT

Method for preventing the formation of coating defects in polymeric coated surfaces in a coating process comprising a plurality of steps that occur prior to the polymeric coating of said surfaces and that contact organic and metal surfaces with a plurality of aqueous compositions in which accumulate in suspension resin particles released from said metal surfaces. Suspended resin particles are prevented from re-depositing on the organic surfaces by converting said surfaces to hydrophilic character by means of oxidizing said surfaces prior to contacting the oxidized surfaces with said suspensions.

25 Claims, No Drawings

PREVENTION OF PARTICLE REDEPOSITION ONTO ORGANIC SURFACES

This application claims priority from United States provisional application Serial No. 60/182,324, filed Feb. 14, 2000, incorporated herein by reference in its entirety.

FIELD OF THE INVENTION

This invention relates to processes useful in the assembly line manufacture of articles including organic surfaces and involving the repeated contacting of aqueous compositions with said surfaces at various points during a multi-step polymeric coating operation. This invention is particularly related to the field of coating plastic parts during the assembly of automobile bodies.

BACKGROUND OF THE INVENTION

Historically, automobiles have been constructed of metal parts the outer surfaces of which have been coated to provide a smooth showroom finish. The materials used to coat the metal comprise predominantly organic polymeric materials, or paints, such as lacquers, polyurethanes, acrylics and such, all of which provide a durable and attractive finish. More recently, automobile manufacturers have incorporated plastic parts into the automobile assembly process to reduce weight and improve rustproofing properties. The introduction of plastic parts into automotive assemblies has presented the automotive industry with challenges including the ability to maintain a uniform, constant color showroom finish on the different substrate materials. Various methods have been adopted to achieve this goal.

Many of the parts making up a typical automotive assembly are not manufactured by the original equipment manufacturer ("OEM") but are produced by specialty suppliers at sites distant from where the final automobile assembly takes place. The plastic parts included in the assembly are normally molded and assembled at supplier facilities where their production and priming (in most cases) is also complex. In the case where plastic parts and sheet metal parts are not subjected to a common coating or painting operation, differences in color tone and/or "look" of the coating films between the two types of materials may remain after the finish coating. Furthermore, the parts are more likely to experience contamination, due to handling during assembly after such individual treatment. It may therefore be difficult to color match both types of parts in this type of operation and more difficult to ensure the quality of the finish due to handling contamination. Therefore, many automobile manufacturers choose to precondition the entire assembly of parts, and paint the completed assembly that includes the plastic parts and the sheet metal parts, referred to as the "body-in-white".

The assembly plant receives the finished plastic component, where it is included in the automotive assembly, after which such components may be subjected to a variety of processes at the same time as the metal parts. These processes include steps leading up to the application of the finish coating of paint to the plastic and metal parts. More specifically, the manufacturing facility assembles the metal parts and plastic body parts into the automotive body-in-white, sends the body-in-white through several pretreatment steps and corrosion resistance processes, and lastly applies the final finish using a series of coating steps. These basic steps encompass the spraying, or dipping, of the assembly with a sequence of aqueous compositions that are recycled in a continuous manner and thereby contact newly assembled plastic and coated metal parts with aqueous compositions that have been in contact with previously treated assemblies of parts. In particular, the pretreatment operation typically comprises the steps of a power wash, a phosphate treatment, and an electrocoating process, each of which may employ an aqueous spray and/or aqueous bath dip process.

The assembly line coating of sheet metal-plastic hybrid assemblies presents problems relating to the actual coating processes and conditions. Since the physical and chemical properties of the plastic parts differ significantly from those of the sheet metal parts, each step in the coating operation must be designed to be compatible with each type of surface. Furthermore, the end result, a showroom quality paint finish, must be practically identical for both the plastic and sheet metal parts. The final properties of color matching, color depth, smoothness, luster, reflectivity, among others, must be uniform through all visible surfaces of the finish coat assembly.

While manufacturers have been successful in designing a series of coating process steps applicable to both plastic and sheet metal parts to achieve the aforementioned goals, the automation of this process has not been altogether successful. One of the daunting problems in coating the plastic and metal parts-containing assembly has been the appearance of defects in the surface quality of the plastic parts and/or metal parts that are pretreated with one or more coatings of organic primer material. These defects manifest as surface irregularities in the final painted surfaces that detract from the acceptability of the end product. To achieve the desired factory fresh showroom finish, manufacturers find it necessary to employ time consuming manual labor to prevent these defects from appearing or to repair such defects after they appear. This of course increases the cost of the overall coating operation.

Reported Developments

Automobile manufacturers have addressed the problem of organic surface defects by incorporating into the automated coating process a labor intensive hand wiping of the plastic and/or coated metal surfaces prior to the final coating operation. Automobile technical bulletins [Brouder, E. "The Problem Recognized: Surface Treatment of Plastics Before Painting" Ind. Anz. 108 (37–38, May 13, 1986) recognized that dust and dirt, fingerprints and parting agents contaminated the surfaces of plastic automobile parts and prescribed a regimen of cleaning solutions containing surfactants and/or antistatic coatings to remove and/or avoid the contamination. This bulletin appears to refer to the treatment of plastic parts separately from sheet metal parts and the removal of contamination resulting from handling the parts during parts manufacture per se and subsequent assembly. The surface contamination problems arising during whole assembly coating are not addressable economically using the cleaning solution method, in view of the recycling of the cleaning solutions which themselves appear to be the source of the problem as discussed below. To this day, hand wiping of the assembly at various stages prior to final coating is the only way, inelegant, as it may seem, by which the industry has addressed the surface defect problem.

Although many sources of contamination resulting in the organic surface defects are possible, the present invention recognizes that the major source of contamination arises from the physical removal of uncured resin particles from the metal surfaces of assemblies undergoing the coating operation The inventors have found that these particles originate with the sealers, sound deadeners, mastics and/or adhesives applied to selected portions of parts, predominately the metal parts, used in the automobile body construction, are removed therefrom by the physical forces present during the aqueous pretreatment steps, and become suspended in the recycling aqueous compositions. The present inventors also believe that on application of the aqueous composition to the sheet metal-plastic assemblies, these particles are redeposited on the organic surfaces, or in other words are transferred from the resin-treated metal surfaces to the organic surfaces. Upon curing of the final coating, the redeposited particles cause surface irregularities or defects in the finish coat.

SUMMARY OF THE INVENTION

The present invention relates to a method for maintaining in aqueous suspension hydrophobic particles contacted with organic surfaces, comprising oxidizing said organic surfaces, contacting said aqueous suspension of hydrophobic particles with said oxidized surfaces, and removing said aqueous suspension from said surfaces.

Another aspect of the present invention is a method of preventing the formation of coating defects in polymeric coated surfaces in a coating process comprising a plurality of steps that occur prior to the polymeric coating of said surfaces and that contact organic and metal surfaces with a plurality of aqueous compositions in which accumulate in suspension resin particles released from said metal surfaces, comprising (1) treating said organic surfaces with a flame, (2) contacting said flame treated surfaces with a plurality of aqueous compositions containing said particles, and (3) removing said surfaces from said plurality of aqueous compositions.

A further aspect of the present invention is an assembly line coating operation comprising the application of an hydrophobic sealer resin onto portions of metal parts combined with parts having organic surfaces in an assembly, contacting said assembly with a plurality of aqueous compositions, applying one or more finish coats to the surfaces of said assembly, and curing said finish coats, the improvement comprising (1) flame treating the surfaces of said organic surface parts, (2) contacting said assembly with a plurality of said aqueous compositions, (3) removing said assembly from each of said plurality of aqueous compositions, and (4) reusing said aqueous compositions with additional assemblies comprising said sealer treated metal parts and said flame treated organic surface parts.

DETAILED DESCRIPTION OF THE INVENTION (1) Definitions

The following terms are used throughout the specification and are intended to have the following meanings:

"Hydrophobic" as used herein means a material having little or no affinity for water.

"Hydrophilic" as used herein means the opposite of hydrophobic, that is a material having affinity for water.

"Flame treating" as used herein means the contacting of a surface with a high temperature gas combustion product of a mixture comprising oxygen and at least one fuel such as hydrogen gas or a hydrocarbon.

"Organic" as used herein means a chemical compound including carbon and at least one or more of hydrogen, oxygen, nitrogen, sulfur, and/or silicon.

"Oxized" as used herein means that a material has increased its oxygen content by the introduction, into a material, of oxygen atoms in the form of molecular functional groups containing oxygen. Exemplary functional groups include hydroxyl, carbonyl, carboxyl, peroxy, oxy, siloxy, nitroxy, and the like.

"Plastic" as used herein means an organic material that at one point in time is capable of attaining a desired shape through processing such as molding, casting or extrusion, and which may retain its moldable properties or thermoplastic properties or lose those properties and become fixed or thermoset. Exemplary plastics include naturally derived and synthetically produced polymeric materials.

A "plastic composition" may include one or more additives, such as reinforcing elements or fillers, such as glass fibers, pigments such as calcium carbonate, or plasticizers, UV-light absorbers and mold release agents. Exemplary thermoset plastic compositions may comprise reaction injection molded (RIM) polyurethane polymers, and compression sheet molded compound (SMC) unsaturated polyesters and injection-molded bulk-molding compound (BMC) unsaturated polyesters.

"Polymer" as used herein means a high molecular weight organic molecule consisting of straight chains or branched chains or mixtures thereof, made up of repeating monomeric units linked together with covalent bonds. The term includes homopolymers, where the repeating unit is identical throughout the polymeric chain, co-polymers, where more than one type of monomeric units is present by design or randomly throughout the polymer chain, or block copolymers, where sections of the polymer can be predominantly of one type of monomeric unit. The polymers may be derived from natural sources such as rubber or produced synthetically through polymerization reactions known in the art. Exemplary polymers used to produce parts or to coat metal surfaces to be treated according to the present invention include polyolefins, such as polyethylene, polypropylene, polybutylene, polymethylpentene; mixtures of polyolefin polymers and copolymers of olefins; polyolefin copolymers containing olefin segments such as poly (ethylene vinylacetate), poly(ethylene methacrylate) and poly(ethylene acrylic acid); polyesters, such as poly (ethylene terephthalate), poly(butylene phthalate) and poly (ethylene naphthalate); acetates such as cellulose acetate, cellulose triacetate and cellulose acetate/butyrate; polyamides such as poly(hexamethylene adipamide); polyurethanes; polycarbonates; acrylics such as poly(methyl methacrylate); polystyrenes and styrene-based copolymers; vinylics such as poly(vinyl chloride), poly(vinylidone dichloride), poly(vinyl alcohol) and poly(vinyl butyral); ether oxide polymers such as polypropylene oxide), poly (phenylene oxide), poly(ethylene oxide) and poly (methylene oxide); ketone polymers such as polyetheretherketone; silicones such as polydiorganosiloxane-based elastomers; epoxies; polyimides; fluoropolymers such as polytetrafluoroethylene; mixtures thereof, or copolymers thereof.

"Polymeric material" as used herein means a material comprising a polymer, polymer blends or polymer matrix compositions.

"Resin" as used herein means a nonvolatile, solid or semisolid organic substance that may be prepared from polymerization of simple molecules. A "resin composition" may include one or more additives, such as reinforcing elements or fillers, such as glass fibers, pigments such as calcium carbonate, or plasticizers, UV-light absorbers and mold release agents, as well as blowing agents and curing agents.

"Uncured Resin" as used herein means a resin that may flow and be readily divisible in the form of a powder, colloidal suspension, emulsion, or liquid, and that is capable of being transformed into a thermoset solid polymeric material upon treatment with energy in the form of heat or radiation, or when combined with a curing agent.

"Surfaces" as used herein means that part of an object that affects or can be affected by its environment. In other words, surfaces comprise the outer boundary of an object that may be immediately contacted by the environment. Polymer surfaces are unique among solid surfaces in that polymeric chains near the surface can be mobile and resemble in many respects a viscous liquid.

(1) Description of the Automotive Coating Process

The coating of automobile assembly parts varies from manufacturer to manufacturer, but the problems associated with coating an assembly consisting of sheet metal and organic surfaces is present in all such operations. This is particularly true in cases where the manufacturer uses resinous sealers, mastics, sound deadeners, and adhesives that are cured only after the finish paint has been applied. As noted above, the surface defect problem associated with the practice of such assembly line coating operations on organic surfaces is believed to occur as a result of the redeposition of uncured resin particles suspended in the aqueous compositions contacted with the organic surfaces of parts prior to curing. The opportunities for this redeposition are more clearly understood by reference to the following generic automotive coating operation.

The formed sheet metal parts, usually sheet steel, galvanized steel, or aluminum, are typically treated on selected surfaces, such as joints, edges and unseen surfaces, prior to the assembly operation. These portions of the metal parts are treated with sealer compositions, such as vinyl plastisols, sound deadener resins, and a variety of mastics or adhesives. These resinous materials are predominantly hydrophobic in character, and are applied in a form of a thickened liquid or caulk which is uncured, that is not "set", or in a partially cured state. Upon subsequent chemical treatment or physical conditioning, such as the application of heat or radiation, the uncured material will set up or fully polymerize or solidify and form a substantially continuous solid layer of cured hydrophobic material. These materials may be applied to the metal parts prior to assembly, or after assembly of the parts into the body-in-white. These materials may be applied to the selected surfaces by brush, applicator, spraying, dipping, electrostatic or electrocoating.

The assembly containing the treated metal parts, organic coated metal parts and plastic parts is then subjected to a variety of process steps including one or more of the following treatments: a washing treatment which may be carried out in a spray system; a degreasing or cleaning treatment which may employ singly or jointly a spray system and/or a dipping system using a formulated aqueous solution including for example, surfactant and other organic and inorganic compounds such as phosphates and/or silicates; a cold washing treatment using a spray system; a chemical conversion treatment spraying with or by dipping in an aqueous solution of metallic phosphate; which may be followed by a cold washing treatment using a spray system and/or a dipping system. In all these foregoing processes, the aqueous compositions applied to the assembly surfaces may be filtered, may have chemicals added periodically to make up for depletion, and are reused in the assembly line process.

The pretreated assembly is then subjected to an electrocoating process that applies a paint layer or undercoating layer primarily to the sheet metal surfaces; however, electrically conductive plastic materials may also be used and coated as well (see for example the disclosure of U.S. Pat. No. 4,974,307). Dipping the assembled parts into an electrodeposition cell may apply the electrodeposition coating. The coating ingredients may thereby be applied substantially uniformly onto the surfaces of the sheet metal parts and, optionally, of any electrically conductive plastic parts, to produce a relatively uniform coating film. The coated assembly may then be subjected to elevated temperatures to cure the coating onto the sheet metal, and optionally onto the electrically conductive plastic parts, into a continuous paint film having high adhesiveness. Alternatively, the electrocoated assembly may proceed directly through the finish coating operation, and all coating layers cured in a single step.

In the succeeding coating operations, one or more coatings may be applied before the finish is cured. An optional second protective coating process may be employed followed by the final finish coating, or the final finish coating process applied without a second protective coating. Conventional spray coating or electrostatic spray coating, followed by curing, may apply the second protective coating, and the finish coating. The cure step may either utilize normal temperature drying or more commonly baking in a curing oven, depending on the type of coating selected.

The present invention prevents the redeposition of hydrophobic particles that become suspended in the aqueous treatment compositions onto the organic surfaces of the parts with which said compositions are contacted. The redeposition phenomenon is believed to arise as the result of the attraction and adhesion of the hydrophobic particles, in aqueous suspension, to the organic surfaces of the parts, which are themselves hydrophobic. Any surface, whether it is a plastic part or an organic coated metal part, will experience the redeposition phenomenon and act as an attractant for the hydrophobic particles suspended in the aqueous compositions used in the automotive coating process.

The present invention solves the redeposition problem by maintaining the suspended particles in the aqueous phase during the contacting with the treated organic surfaces. The process reduces the hydrophobic attraction between the particles and the organic surfaces by modifying the properties of the organic surfaces to increase the hydrophilicity thereof. As a result, the modified surfaces do not function as a hydrophobic attractant and the aqueous compositions can be removed from the assembly without depositing substantially any particles onto the modified organic surfaces. The only surfaces that thereafter act as an attractant for the suspended particles are the same surfaces from which the particles had been detached, the surfaces treated with sealers, mastics, sound deadeners and adhesives, or any organic surfaces that has not been treated according to the process of the present invention. The aqueous compositions removed from contact with the automotive assemblies thereafter contain amounts of hydrophobic particle suspendant that result from the net loss of uncured particles from the remaining hydrophobic surfaces on the assembly.

The surface modification of the present invention results preferably from an oxidation reaction. Techniques of oxidizing organic surfaces, such as those used in the manufacture of automotive assemblies, are well known in the art, and include chemical oxidation such as chromic acid etching, corona discharge treatment, plasma treatment and flame treatment. Flame treatment is a well known method to oxidize polymeric material surfaces and has been described in the literature as a method of modifying the surfaces of polymeric films, as well as molded or extruded plastic articles, and to metal surfaces that have been coated with a polymeric coating. The resulting films and articles are described as providing a surface with improved adhesion to overcoatings of polymeric materials such as in painting and adhesive bonding.

The preferred method of oxidizing the organic surfaces of the assembly parts is flame treatment. A preferred method according to the present invention comprises the contacting of the plastic surface with a flame at a temperature, distance and length of time to oxidize said surface to a depth sufficient to convert any hydrophobic character thereof to a hydrophilic character but not deep enough to alter the physical properties of the plastic part. Flame treatment has the advantage of being controlled such that oxidizing the organic surface may be effected to a depth of only a few angstroms, more particularly between about 40 and about 90 angstroms (see Briggs et al, Journal of Materials Science, 14 (1979) 1344, at 1347). This level of treatment is sufficient to modify the surface characteristics as required by the present invention to act as a hydrophilic surface as opposed to a hydrophobic surface without adversely affecting the shape, strength or other physical properties of the article.

Flame treating has been reported in the prior art to improve the wetting and adhesion properties of polymer film surfaces in general and of polyolefin film surfaces in particular. Many types of flame treatment processes and equipment are available. Typically, flame treaters use premixed flames, i.e., the fuel and oxidizer are thoroughly mixed prior to combustion and the rate of combustion is controlled by the rate of chemical reaction that occurs in the flame. In a premixed flame, the luminous region is that portion of the flame where the temperature rise is the greatest and where much of the reaction and heat release occur. During a flame-treating process, one side of a polymer surface is passed in close proximity to a flame. The other side of the polymer surface may require cooling although such cooling is not necessary for plastic parts that are as thick as typically used in automobile assemblies.

Flames are commonly described in terms of two characteristics: by the flame power and by the molar ratio of oxidizer to fuel. The flame power is the product of the volume of fuel burned per unit time and the heat content of the fuel. Typical units for the flame power are W or Btu/hr. In flame treating, the flame power can be normalized to account for the dimensions of the burner, leading to units such as $W/cm^2$ or $Btu/hr\text{-}in^2$. The exact ratio of oxidizer to fuel needed for complete combustion is known as the stoichiometric ratio. For example, the exact amount of dry air necessary for the complete combustion of methane is 9.55 volumes per volume of methane; so the stoichiometric ratio for an air: methane flame is 9.55:1. The equivalence ratio is defined as the stoichiometric oxidizer: fuel ratio divided by the actual oxidizer: fuel ratio. For fuel-lean, or oxidizing, flames, there is more than the stoichiometric amount of oxidizer and so the equivalence ratio is less than 1:1. For oxidizer: fuel mites at the stoichiometric ratio, the equivalence ratio is equal to 1:1. For fuel-rich systems, the equivalence ratio is greater than 1:1.

Virtually all industrial flame treaters use a premixed laminar (as opposed to turbulent) flame with air as the oxidizer and a gaseous hydrogen containing fuel. Typical fuels include hydrogen and hydrocarbons such as natural gas, methane, ethane, propane, butane, ethylene, liquefied petroleum gas, acetylene, or blends thereof, and city gas, which is often composed of a mixture of carbon dioxide, carbon monoxide, hydrogen, methane, and nitrogen. Halogen and halogen-containing compounds have also been disclosed as oxidizer: fuel mixture additives to increase the adhesivity of polyolefin films to subsequent coatings.

Hydrocarbon flames enriched with up to 5 percent additional oxygen by volume, up to 5 percent steam by weight and a few parts per million of alkali or alkaline earth metals have demonstrated increases in wetting values on polymer films (American Standard Test Methods (ASTI standard wetting test) of up to 2 $mJ/m^2$ relative to a non-enriched flame process. Surface modification of a polymer surface has also been reported by flame treatment where a flammable third component that is neither a fuel nor an oxidizer is sprayed into the flame. The listed third components are polymers such as cellulose, protein, silicones or polyethers, and inorganic materials such as carbides, nitrides, metal salts or metal oxides.

The temperature and time of contact of the flame with the organic surface being treated are variables determined by those skilled in the art. These variables are expected to change slightly depending on the organic surface being treated and the composition of the fuel used in the flame treatment device. Heating of the organic surface is generally regarded as undesirable and unnecessary to achieve the chemical reaction of the organic surface with the high-energy oxygen radicals present in the flame. In all cases, the flame temperature and time of contact with any particular section of the organic surface should be such as to oxidize the surface to an extent to render it hydrophilic, and not cause any undesirable consequences such as melting, deformation, charring or structural weakening of the part.

From the scientific literature, it is known that as a result of the fluid nature of polymeric surfaces, oxidized surface functional groups of polymeric materials appear to turn inward from the surface over time. The result is a loss of hydrophilic surface characteristics over time. Although the flame treatment process used in the present invention may be implemented in the assembly line such that little time would pass between flame treatment and contact with the aqueous compositions in the pretreatment process, the process may be implemented for some or all of the plastic parts at distant facilities requiring the effects of the treatment to be more or less permanent. If the OEM chooses to combine pre-flame treated plastic parts with the metal parts into the automotive assembly, then the flame treatment must take advantage of techniques that preserve the hydrophilic character of the modified polymeric surfaces.

The prior art discloses a variety of methods to maintain the oxidized, and hence, hydrophilic nature of flame treated polymeric surfaces over time.

U.S. Pat. Nos. 5,753,754, 5,891,967, 5,900,317, hereby incorporated by reference, teach the modification of the combustion to include either silicon-containing compounds, oxygencontaining compounds or nitrogen-containing compounds to deposit onto the surface chemical species possessing the required hydrophilic character required over time.

U.S. Pat. No. 5,879,757, hereby incorporated by reference, teaches the application of an organofunctional coupling agent such as an organo-functional silane, organo zirconate, organo titanate, organo tin or organoaluminate, to an oxidized surface simultaneously with the application of a static or high frequency alternating physical field such as an ultrasonic, microwave or radio frequency field. The resulting surface is described as having improved adhesive properties.

U.S. Pat. No. 5,922,161, hereby incorporated by reference, teaches the application of a solution of a multi-functional amine containing organic compound to the oxidized surface to attain improved adhesive properties and modify the hydrophilicity of polymer coated metal products.

The following examples describe an assembly consisting of steel or other sheet metal and plastic parts being coated in an assembly line manufacturing operation.

EXAMPLE 1

Sheet steel, galvanized steel and aluminum parts are combined with organic surface parts to form the automobile body-in-white. The sheet metal parts are treated at various stations of the assembly plant with a variety of materials including sealers for selected portions of the metal parts, such as joints, metal edges susceptible to chipping and cracking, sound deadener compositions for the undersides of the carriage and wheel wells, etc., and adhesives and mastics for a variety of purposes. The body-in-white enters the flame treatment station where the organic surface parts are flame treated before entering the pretreatment station consisting of the power washing, phosphate and electrocoating operations. The organic surface parts to be treated are situated in an accessible manner to permit flaming by a robotic apparatus programmed to selectively contact the flame with only the target organic surface parts at pre-selected flame condition, for a defined time and at a defined distance. The robotic operated flame device is programmed to avoid contact with bare metal surfaces to prevent the oxidation or varnishing of oils or other surface contaminants which would inhibit their subsequent removal by the washer and, consequently, interfere with the zinc phosphate and electrocoating operation. The robot may be programmed to flame a surface more than once to ensure the completeness and uniformity of the treatment.

In an automotive assembly including an organic-surfaced hood assembly, the hood is propped open, as the automobile assembly is viewed in car position, and the hood surfaces robotically flame treated with enough precision to avoid flame contact with the adjacent metal skin. The propped open hood is either lowered or left in the propped open condition for transit through the following power wash-phosphate-electrocoat stages. The robotic apparatus is programmed to process the flame tips of the flame apparatus over substantially 100% of the hood's externally visible surface. All organic surface parts that remain visible to the consumer are so treated with the robotic flame device in a similar manner. An alternative strategy is to flame the organic-surfaced part in such a way as to leave a small "edge" of untreated area as a practical compromise to complete flame treatment.

The flame treated assembly is passed into the power wash station and contacted with a sequence of aqueous wash compositions. The assembly is first contacted with an optional pre-wash composition using tap water or a slightly alkaline composition at high spray pressures. The next stage contacts the assembly with an aqueous alkaline degreasing cleaner at elevated temperature (115–130 degrees F.). The cleaner includes surfactant, alkaline sodium or potassium phosphate salts, silicates and stabilizers. The assembly exits the degreasing station, is rinsed with aqueous rinse compositions and misted until it reaches the phosphate station. The aqueous wash compositions used in the foregoing steps are recycled time and again in this operation, during which particles, ranging on the order of 1 cm and diameter or less, of uncured sealer, sound deadeners and other materials are detached from the treated metal surfaces and suspended in the compositions.

The power-washed assembly enters the phosphate treatment station and is contacted with an aqueous conditioning composition including complex titanium phosphate salts, and optionally, water softening agents. The conditioned assembly is then contacted by spraying or immersion into an aqueous composition including zinc, manganese, nickel and iron phosphate compounds designed to impart a crystalline phosphate coating to metal surfaces of the assembly. The phosphate treated assembly is treated with one or more aqueous rinses, optionally containing soluble chromium compounds or other compounds, and in cases where the rinses contain such compounds, a deionized or other purified aqueous rinse. During this process, the aqueous compositions take into suspension particles, ranging on the order of 1 cm and diameter or less, of uncured sealer, sound deadeners and other materials that are detached from the treated metal surfaces and/or brought into the station from contact with the previous washer composition. The assembly exits the phosphate station and the aqueous compositions recycled to treat the bodies-in-white that follow in the assembly line.

The phosphate treated body-in-white enters the electrocoating station, where a rust inhibitor first primer resin material is applied. The body-in-white is lowered into the electrocoating bath containing the paint resin particles suspended or in emulsified form, along with pigments such as carbon black and one or more corrosion inhibiting and/or filler pigments. A voltage is applied for a predetermined period of time to transfer a coating of resin particles to deposit onto the metal surfaces, and the assembly removed. The electrocoating composition is applied principally to the electrically conductive assembly parts, which are the metal parts, but may also include specially prepared plastic parts in which electrically conductive materials are impregnated. The electrocoated assembly is then contacted with one or more aqueous rinses. During this process, the aqueous compositions take into suspension particles, ranging on the order of 1 cm and diameter or less, of uncured sealer, sound deadeners and other materials, which are detached from the treated metal surfaces and/or brought into the station from contact with the previous washer and/or phosphate station compositions. After the assembly exits the electrocoating station, the aqueous electrocoating station compositions are used again to treat the bodies-in-white that follow in the assembly line.

After the electrocoating treatment, the assembly proceeds to the curing oven where the assembly is dried and baked until the electrocoated resin, and all the resin materials applied to the metal parts are cured into thermoset materials. After the undercoating is cured, the assembly proceeds to the final coating operation where it receives a uniformly applied primer, color coat and clear coat. This is followed by a second curing process that involves drying, baking and optionally UV radiation treatment. The coated surfaces of the metal and plastic parts making up the finished automotive assembly are smooth, lustrous and surface defect free.

Comparative Example 2

In the above example, the organic-surfaced parts are not flame treated. The following subsequent process step must then be added.

After the electrocoating station but before the electrocoat cure oven, the organic surface parts are hand wiped with solvent soaked cloths by two or more factory workers to remove particle debris picked up from the wash, phosphate and electrocoating aqueous compositions.

Comparative Example 3

When the hand wiping of Example 2 is not used to remove the hydrophilic particles from the automotive assembly parts, the resulting finish coat exhibits surface bumps that reflect light in an unappealing manner.

EXAMPLE 4

The plastic and organic coated metal parts used in the assembly are flame treated prior to the assembly into the body-in-white. This completely avoids adversely affecting any metal surfaces, simplifies the flame application programming for the robotic apparatus, and avoids the necessity of propping up the organic-surfaced parts so that they could be flamed after assembly.

EXAMPLE 5

The organic-surfaced parts are flame treated at a special facility before delivery to the assembly plant or treated at the facility where the part is originally manufactured. This technique of off-site flaming provides better control, cleaner facilities, and more readily as. available floor space for handling and storing the parts. To prevent the decay of the hydrophilicity of the organic surface parts during storage and transportation prior to entry into the pretreatment process, the flame treatment process incorporates one or more fuel additives in the flame fuel as taught by one or more of the prior art patent disclosures referred to above.

Alternatively, the surfaces are contacted, by spraying or dipping, with a less than 5% aqueous solution of a multifunctional amine-containing compound, such as a polyethylene imine, as taught in the prior art referred to above or with other molecular species with an ability to react with the active sites created on the organic surfaces by the oxidation treatment. Excess chemical reactant is removed by air knife blow off, rinse, or other method. The multifunctional chemical is allowed to react with the grafted oxygenated sites on the organic surfaces by time, heat cure, or oscillating field cure, or a combination of these methods.

Using either process described above, the flame treated organic surface part retains its hydrophilic character so as to avoid attracting the redeposition of hydrophobic particles from the aqueous compositions used in the wash-phosphate and electrocoating stages of the automotive assembly coating operation.

It has been further discovered that the rate of degradation of the hydrophilic character of the organic surfaces treated in accordance with the present invention varies depending on the particular organic material comprising the surface. Reversion to hydrophobic character may be observed in some cases within minutes of subjecting the oxidized surface to high humidity conditions, while other oxidized organic surfaces retain their hydrophilicity for days and weeks after treatment. Surprisingly, it is possible to refresh the hydrophilic character of the oxidized surfaces that have reverted to hydrophobic character by contacting the degraded surfaces with an aqueous alkaline composition. Exemplary aqueous alkaline compositions include the alkaline wash solutions used in the automotive coating operations described herein.

We claim:

1. A method form maintaining hydrophobic particles in aqueous suspension when said aqueous suspension is in contact wit organic surfaces, comprising oxidizing said organic surfaces to form oxidized surfaces, contacting said oxidized surfaces with said aqueous suspension of hydrophobic particles, and removing said oxidized surfaces from said aqueous suspension that maintains said particles in suspension, wherein said particles comprise uncured resin particles.

2. The method according to claim 1 wherein said organic surfaces are contacted with a flame at a temperance, distance and length of time to oxidize said organic surfaces to convert any hydrophobic character thereof to a hydrophilic character.

3. The method according to claim 1 wherein said organic surfaces comprise thermoset polymeric surfaces.

4. The method according to claim 3 wherein said aqueous suspension is repeatedly placed in contact with said thermoset polymeric surfaces.

5. The method according to claim 4 wherein said uncured resin particles are comprised of a vinyl plastisol.

6. A method according to claim 2 wherein said organic surfaces having hydrophilic character are contacted with an aqueous alkaline composition prior to contacting with said aqueous suspension of hydrophobic particles.

7. A method according to claim 6 wherein said organic surfaces having hydrophilic character are subjected to conditions that degrade the hydrophilic character thereof prior to said contacting.

8. A method according to claim 6 wherein said contacting with said aqueous alkaline composition refreshes the hydrophilic character of said surface.

9. A method according to claim 8 wherein said organic surfaces comprise polyurethane or polyester.

10. A method according to claim 2 wherein said aqueous suspension comprises an alkaline composition.

11. A method according to claim 10 wherein said organic surfaces having hydrophilic character are subjected to conditions that degrade the hydrophilic character thereof prior to said contacting.

12. A method according to claim 11 wherein said organic surfaces comprise polyurethane or polyester.

13. A method of preventing the formation of coating defects in polymeric coated organic surfaces in a coacting process comprising a plurality of steps, which steps occur prior to the polymeric coating of said surfaces and, which steps contact thermoset polymeric organic surfaces and metal surfaces, to which metal surfaces uncured resin particles have been applied, with a plurality of aqueous compositions in which resin particles released from said metal surfaces accumulate in suspension, said steps comprising (1) treating said thermoset polymeric organic surfaces with a flame, (2) contacting said flame treated surfaces with said plurality of aqueous compositions containing said particles, and (3) removing said surfaces from said plurality of aqueous compositions.

14. A method according to claim 13 wherein said plurality of aqueous compositions includes a first cleaner composition in which sealer particles are suspended.

15. A method according to claim 14 wherein said plurality of aqueous compositions is contacted with sealer resin on portions of said metal surface.

16. A method according to claim 15 wherein said aqueous compositions are used repeatedly in said process.

17. A method according to claim 15 wherein said sealer resin comprises a vinyl plastisol.

18. A method according to claim 17 wherein said vinyl plastisol resin particles are uncured and present in a first aqueous composition during power washing, in a second aqueous composition used in phosphate coating and in a third aqueous composition used for electrocoating said metal surfaces.

19. A method according to claim 17 wherein said first aqueous composition is alkaline.

20. In a process for the assembly line coating of an assembly of pans comprising metal surfaces and thermoset polymeric organic surfaces, said process comprising the application of a hydrophobic sealer resin onto portions of metal surface parts combined in said assembly, contacting said assembly with a plurality of aqueous compositions, applying one or more finish coats to said metal surfaces and thermoset polymeric organic surfaces of said assembly, and curing said coating, the improvement comprising (1) flame treating the surfaces of said thermoset polymeric organic surface parts, (2) contacting said assembly, comprising said flamed treated organic surface parts and said metal pans on which hydrophobic sealer resin has been applied, with a plurality of said aqueous compositions, (3) after contacting said aqueous compositions with said assembly, recovering said plurality of aqueous compositions, and (4) reusing said plurality of aqueous compositions with additional assemblies comprising said flame treated organic surface parts and said metal parts having metal surfaces on which hydrophobic sealer resin has been applied.

21. In a process of assembly line coating of hydrophobic resin materials onto assemblies consisting essentially of parts having thermoset polymeric organic surfaces and metal surfaces, said process including applying hydrophobic sealer resin compositions to portions of metal surfaces, power washing said organic surfaces and hydrophobic sealer treated metal surfaces with a first aqueous composition, phosphate-treating said power-washed surfaces with a second aqueous composition, and electrocoating said phosphate-treated surfaces with a third aqueous composition, wherein sealer resin particles having an affinity for hydrophobic surfaces accumulate in suspension in said aqueous compositions, the improvement comprising, (1) prior to contacting said thermoset polymeric organic surfaces with any of said aqueous compositions, oxidizing said organic surfaces in a manner sufficient to convert any hydrophobic character thereof to hydrophilic character; and (2) wherein after contacting with said third aqueous composition, said oxidized thermoset polymeric organic surfaces of said electrocoated assemblies are substantially free of uncured resin particles.

22. The improved process according to claim 21 wherein said oxidized organic surfaces are contacted with an aqueous alkaline composition prior to contacting with said first, second or third aqueous compositions.

23. The improved process according to claim 21 wherein said hydrophobic sealer particles comprise uncured resin particles of less than about 1 cm in size.

24. The method according to claim 21 wherein said oxidation comprises contacting said thermoset polymeric organic surfaces with a flame at a temperate, distance and length of time to oxidize said surfaces such that any hydrophobic character thereof is converted into a substantially hydrophilic character.

25. A method according to claim 24 wherein said oxidation affects the organic surfaces to a depth of about 40 to about 90 angstroms.

* * * * *

UNITED STATES PATENT AND TRADEMARK OFFICE

CERTIFICATE OF CORRECTION

PATENT NO. : 6,406,748 B2
DATED : June 18, 2002
INVENTOR(S) : Held, III et al.

It is certified that error appears in the above-identified patent and that said Letters Patent is hereby corrected as shown below:

Column 11,
Line 59, delete “form”; and insert therefor -- from --.
Line 61, delete “wit”; and insert therefor -- with --.

Column 12,
Line 2, delete “temperance”; and insert therefor -- temperature --.
Line 35, delete “coacting”; and insert therefor -- coating --.

Column 13,
Line 2, delete “pans”; and insert therefor -- parts --.
Line 13, delete “pans”; and insert therefor -- parts --.

Column 14,
Line 3, delete “temperate”; and insert therefor -- temperature --.

Signed and Sealed this

Fourth Day of March, 2003

JAMES E. ROGAN
*Director of the United States Patent and Trademark Office*